US008469099B2

(12) United States Patent
Watson

(10) Patent No.: US 8,469,099 B2
(45) **Date of Patent: *Jun. 25, 2013**

(54) HYDRAULIC FRACTURING OF SUBTERRANEAN FORMATIONS

(75) Inventor: Marshall Charles Watson, Midland, TX (US)

(73) Assignee: ACT Operating Company, Midland, TX (US)

( * ) Notice: Subject to any disclaimer, the term of this patent is extended or adjusted under 35 U.S.C. 154(b) by 378 days.

This patent is subject to a terminal disclaimer.

(21) Appl. No.: 12/839,931

(22) Filed: Jul. 20, 2010

(65) Prior Publication Data

US 2010/0282471 A1 Nov. 11, 2010

Related U.S. Application Data

(63) Continuation-in-part of application No. 12/260,786, filed on Oct. 29, 2008, now Pat. No. 7,770,647.

(51) Int. Cl.
*E21B 43/267* (2006.01)
*E21B 43/27* (2006.01)

(52) U.S. Cl.
USPC ..... 166/308.3; 166/280.1; 166/307

(58) Field of Classification Search
None
See application file for complete search history.

(56) References Cited

U.S. PATENT DOCUMENTS 3,768,564 A 10/1973 Knox et al.
4,044,833 A 8/1977 Volz
4,566,539 A 1/1986 Perlman
4,665,990 A 5/1987 Perlman
5,310,003 A 5/1994 Jennings
5,470,823 A 11/1995 Williams et al.
5,967,233 A 10/1999 Riese et al.
2007/0240880 A1 10/2007 Olsen
2010/0101795 A1 4/2010 Watson et al.

OTHER PUBLICATIONS

Economides, M.J., et al., Reservoir Stimulation, 3rd ed., Chichester, England; New York: J. Wiley. 1 v., 88 pages Part 1 of 2.
Economides, M.J., et al., Reservoir Stimulation, 3rd ed., Chichester, England; New York: J. Wiley. 1 v., 104 pages Part 2 of 2.
Olsen, T.N., et al., "Improvement Process for Coalbed Methane Natural Gas Completion and Stimulation," Presented at the SPE ATC, Denver, CO, Oct. 5-8, 2003, 16 pages.
Diamond, W.P., et al., "Effects of Stimulation Treatments on Coalbeds and Surrounding Strata: Evidence From Underground Observations," Pittsburgh, PA: U.S. Dept. of the Interior, Bureau of Mines, ii, 1987, 53 pages.

(Continued)

*Primary Examiner* — Zakiya W Bates
(74) *Attorney, Agent, or Firm* — Edmonds & Nolte, PC

(57) ABSTRACT

Methods of hydraulically fracturing subterranean coal seams and formations resulting in improved permeability to stimulate Coalbed Methane. In one method, the coal seam is fractured using a proppant-containing fracturing fluid in alternating stages with an aqueous base solution that etches the fracture faces of the coal thereby creating channels for fluid flow. In another method, the coal seam is fractured using a fracturing fluid without propping agents in alternating stages with an aqueous oxidizing solution that is pumped at a pressure sufficient to maintain the fractures in an open position thereby etching the fracture faces to create channels for fluid flow. In yet another embodiment, the aqueous oxidizing agent solution is pumped into the formation at a pressure sufficient to create fractures therein and simultaneously etch the faces of the open fractures to thereby form channels in the faces for increased fluid flow.

24 Claims, 4 Drawing Sheets

OTHER PUBLICATIONS

Wang, S.G., et al., "Case Studies of Propped Refracture Reorientation in the Daqing Oil Field," Presented at the SPE Hydraulic Fracturing Technology Conference, College Station, TX, 2007, 7 pages.
Myers, R.R., et al., "Field Application of an Alternative Foaming Agent for Coalbed Methane in the Nora Field in Southwestern Virginia," Presented at the Eastern Regional Meeting, Charleston, WV, Oct. 20-22, 1999, 15 pages.
Hollub, V.A., et al., "A Guide to Coalbed Methane Operations," Chicago, IL: Gas Research Institute, 1992, 18 pages.
Penny, G., et al., "Microemulsion Additives Enhance Fluid Recover, Provide H2S Mitigation, and Prevent Formation Damage for Stimulation, Drilling and Remediation Operations," Presented at the Southwest Petroleum Short Course, Lubbock, TX, Apr. 20-21, 2005, 9 pages.
Nguyen, P.D., et al., "Controlling Formation Fines at Their Sources to Maintain Well Productivity," SPE Production & Operations. 22(2): p. 202-215, May 2007, 19 pages.
Zahid, S., et al., "Development of Unconventional Gas Resources: Stimulation Perspective," Presented at the Production and Operatyions Symposium, Oklahoma City, OK, Mar. 31-Apr. 3, 2007, 11 pages.
Palmer, I.D., "Induced Stresses Due to Propped Hydraulic Fracture in Coalbed Methane Wells," Presented at the Low Permeability Reservoirs Symposium, Denver, CO, Apr. 26-28, 1993, 12 pages.
Rodvelt, G., et al., "Multiseam Coal Stimulation Using Coiled-Tubing Fracturing and a Unique Bottomhole Packer Assembly," Presented at the SPE Eastern Regional meeting, Canton, OH, Oct. 17-19, 2001, 11 pages.
Byrne, W.E., et al., "Composite Bridge Plug Technology for Coalbed Ethane Increases Efficiency and Reduces Costs of Completing CBM Wells," Presented at the International Coalbed Methane Symposium, Tuscaloosa, AL, May 22-24, 2007, 9 pages.
Palmer, I., et al., "CBM Well Completions and Production: Field Data, Best Practices, New Technology," Presented at the 2007 International Coalbed Methane Symposium Short Course Tuscaloosa, AL May 22, 2007, 96 pages Part 1 of 2.
Palmer, I., et al., "CBM Well Completions and Production: Field Data, Best Practices, New Technology," Presented at the 2007 International Coalbed Methane Symposium Short Course Tuscaloosa, AL May 22, 2007, 85 pages Part 2 of 2.
"A Range of Solutions Available, More Technology on the Way," in Coalbed Methane, May 2003, pp. 12-16.
PCT/US2011/044551 International Search Report and Written Opinion dated Dec. 23, 2011 (8 pages).

HYDRAULIC FRACTURING OF SUBTERRANEAN FORMATIONS

CROSS-REFERENCE TO RELATED APPLICATIONS

The present application is a continuation-in-part of co-pending U.S. patent application Ser. No. 12/260,786 entitled "Hydraulic Fracturing of Subterranean Formations," filed on Oct. 29, 2008. The contents of which are hereby incorporated by reference in their entirety.

BACKGROUND OF THE INVENTION

Coalbed Methane (CBM) is a natural gas formed by geological processes in coal seams and consists predominantly of methane, the major chemical component in natural gas. CBM is an all in one natural gas resource as it serves as the source, reservoir, and trap for a vast amount of potential natural gas. Typically, CBM can be found unexploited at relatively shallow depths, and because methane is stored in coal by a different means than conventional gas, more gas per unit volume can be recovered at these shallow depths.

Various methods have been utilized by the energy industry to extract CBM from subterranean formations. In most instances wellbores are drilled to penetrate the hydrocarbon-containing formations into sections commonly referred to as "production intervals." A subterranean formation penetrated by a wellbore may have multiple production intervals at various depths in the wellbore. Generally, after a wellbore has been drilled to a desired depth, completion operations may be undertaken, usually involving the insertion and cementing of steel casing into the wellbore. In order to extract hydrocarbons from the coal seam, the casing and cement housing are perforated to create production intervals through which hydrocarbons can flow into the wellbore and ultimately to the surface.

To enhance hydrocarbon production, the production intervals are often stimulated by a variety of methods that have been developed and used successfully for increasing the production of CBM from coal seams. Typical stimulation operations may involve hydraulic fracturing, acidizing, fracture acidizing, or combinations thereof. Hydraulic fracturing generally includes injecting or pumping a viscous fracturing fluid into a portion of the subterranean formation at a rate and pressure such that fractures are formed or enhanced into the portion of the subterranean formation. The incident pressure causes the formation to crack which allows the fracturing fluid to enter and extend the crack further into the formation. The fractures tend to propagate as vertical and/or horizontal cracks located radially outward from the wellbore.

In such treatments, once the hydraulic pressure is released, the fractures formed will tend to close back onto themselves, possibly preventing hydrocarbon flow. To prevent this closure, a sieved round sand known as proppant can be disposed in the fractures by suspending them in the pumped fracturing fluid during at least a portion of the fracturing operation. The proppant is carried into the newly created fractures and deposited therein such that when the hydraulic pressure is released the proppant acts to prevent the fracture from fully closing and provides highly permeable conduits through which the formation fluids can be produced back to the well.

In some applications, hydraulic fracturing stages are immediately followed by the injection or pumping of an acidizing solution which can flow above the fracturing fluid and proppant deposited in the lower portion of a vertical fracture, thus having a tendency to widen and vertically extend the upper portion of a fracture. Acidizing may also initiate new fractures and clean the wellbore and fracture faces by dissolving any precipitates or contaminants due to drilling or completion fluids or cement which may be present at or adjacent the wellbore or fracture faces.

It nonetheless remains desirable to find improved methods for fracturing and stimulating new or existing subterranean coal seams. It is desirable to find methods that introduce different fracturing fluids having diverse chemical properties and methods that reduce or eliminate the need for proppants. By doing so, significant savings of time and operating expense may be accrued.

SUMMARY OF THE DISCLOSURE

The present disclosure is directed to a method for generating fractures within a subsurface coal seam resulting in improved conductivity for the stimulation of Coalbed Methane (CBM). In particular, the present disclosure relates to methods of hydraulically fracturing subsurface coal seams, and further forming channels of high-fluid conductivity thereon by means of chemical etching involving aqueous oxidizing agents. As such, the present disclosure may reduce, or eliminate completely, the need for proppants and/or proppant carriers, like gels or foams. In other embodiments, however, suitable propping agents may be added to further increase CBM productivity.

In an exemplary embodiment of the present disclosure a method of fracturing a subsurface coal formation penetrated by a well is disclosed. The method may include treating the well and the subsurface coal formation with an acid to dissolve precipitates, contaminants, completion fluids, or cement which may be present at or adjacent the well, pumping a fracturing fluid containing propping agents into the subsurface coal formation adjacent the well in a multiplicity of stages and at a pressure sufficient to initiate the propagation of at least one fracture within the coal formation, and pumping additional acid into the well and the at least one fracture to dissolve acid-soluble materials. The method may further include alternatingly pumping an oxidizing agent solution into the subsurface coal formation following each of the multiplicity of stages, whereby the oxidizing agent solution etches channels into fracture faces, and overflushing the subsurface coal formation with a fluid configured to transport accumulated coal fines deeper into the subsurface coal formation for improved methane extraction.

In another exemplary embodiment, another method of fracturing a subsurface coal formation penetrated by a well is disclosed. The method may include treating the well and the subsurface coal formation with an acid to clean the well and subsurface coal formation, pumping a fracturing fluid into the subsurface coal formation to induce at least one fracture thereby exposing at least one fracture face, and pumping additional acid into the well and the at least one fracture to dissolve acid-soluble materials. The method may further include pumping an oxidizing agent solution into the subsurface coal formation while maintaining the at least one fracture in an open position to etch channels into the at least one fracture face.

In yet another exemplary embodiment, another method of fracturing a subsurface coal formation penetrated by a well is disclosed. The method may include treating the well and the subsurface coal formation with an acid to clean the well and remove acid-soluble minerals from the subsurface coal formation, and pumping an oxidizing agent solution into the subsurface coal formation at a pressure sufficient to create and open at least one fracture, thereby exposing at least one fracture face to be etched by the oxidizing agent solution and form channels thereon. The method may further include pumping additional acid into the well and the at least one fracture to dissolve acid-soluble materials, and pumping additional oxidizing agent solution at a pressure less than the pressure sufficient to create and open the at least one fracture such that the at least one fracture closes while the additional oxidizing agent solution is pumped through the channels to enlarge the channels.

In yet another exemplary embodiment, a method of stimulating a subsurface coal seam penetrated by a wellbore having a wellbore intake, wherein the subsurface coal seam was previously stimulated, is disclosed. The method may include treating the wellbore and the subsurface coal seam with an acid to clean the wellbore and subsurface coal seam, injecting a hydrogen peroxide solution into the wellbore and subsurface coal seam at a pressure below the fracture pressure of the subsurface coal seam, wherein the subsurface coal seam has at least one existing fracture, and allowing the hydrogen peroxide solution to channel through the at least one existing fracture. The method may further include overflushing the subsurface coal formation with a fluid configured to transport accumulated coal fines deeper into the subsurface coal formation for improved methane extraction.

In yet another exemplary embodiment, another method of stimulating a subsurface coal seam penetrated by a wellbore having a wellbore intake, wherein the subsurface coal seam was previously stimulated, is disclosed. The method may include treating the wellbore and the subsurface coal seam with an acid to clean the wellbore and subsurface coal seam, injecting a hydrogen peroxide solution into the wellbore and subsurface coal seam to cause a pressure on the subsurface coal formation sufficient to create and open at least one fracture, and allowing the hydrogen peroxide solution to channel through the at least one existing fracture. The method may further include reducing the pressure on the subsurface coal formation so that the at least one fracture closes but the fluid flow channels remain for fluid flow, and overflushing the subsurface coal formation with a fluid configured to transport accumulated coal fines deeper into the subsurface coal formation for improved methane extraction.

DETAILED DESCRIPTION

Figure 1:
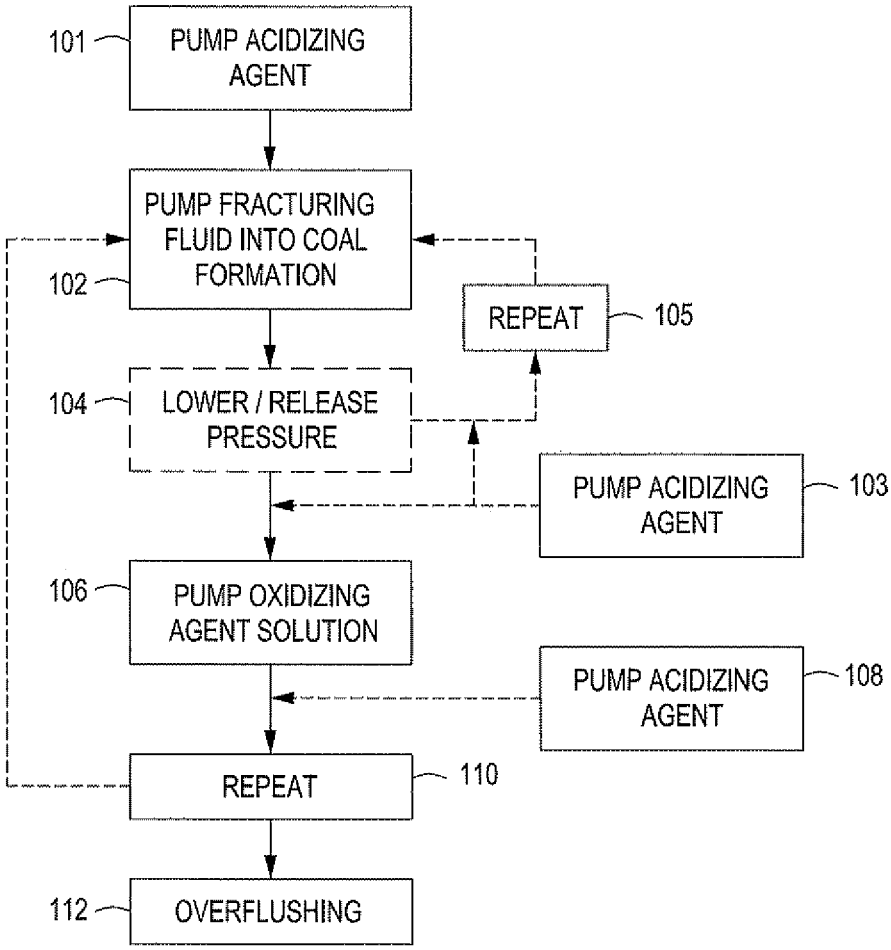
FIG. 1 is a schematic flowchart of a method according to one or more aspects of the present disclosure.

It is to be understood that the following disclosure describes several exemplary embodiments for implementing different features, structures, or functions of the invention. While exemplary embodiments of components, arrangements, and configurations are described below to simplify the present disclosure, these exemplary embodiments are provided merely as examples and are not intended to limit the scope of the invention. Further, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Further, in the following discussion and in the claims, the terms "including" and "comprising" are used in an open-ended fashion, and thus should be interpreted to mean "including, but not limited to." Furthermore, as it is used in the claims or specification, the term "or" is intended to encompass both exclusive and inclusive cases, i.e., "A or B" is intended to be synonymous with "at least one of A and B," unless otherwise expressly specified herein.

Exemplary methods contemplated herein include alternatingly injecting or pumping (e.g., stagewise) a fracturing fluid with an oxidizing agent solution into a subsurface coal seam formation adjacent to a wellbore to create fractures in the coal seam and etch the surfaces of the newly formed fractures. The method may also include intermittingly pumping alternating stages of acid into the wellbore to remove or dissolve impurities and/or acid-soluble minerals and extend the fracture length. In at least one embodiment, the fracturing fluid may contain a proppant, or propping agent. The oxidizing agent solution may be pumped to react with, etch, and/or roughen the coal fracture faces thereby providing good conductivity and permeability for fluid flow when the operation is complete. Methods described herein may be carried out using commercially-available, standard hydraulic fracturing equipment, including proppant-water mixing and pumping equipment.

Referring to FIG. 1, an exemplary method of fracturing a coal formation adjacent a wellbore for hydrocarbon recovery is depicted. The method may include pumping an acidizing agent into the wellbore and wellbore perforations, as at 101. In at least one embodiment, the acidizing agent may be pumped into the wellbore and adjacent coal seams at a pressure sufficient to initiate the propagation of at least one fracture within the coal formation, thereby exposing one or more fracture faces in the coal formation. In other embodiments, however, the acidizing agent is pumped at pressures that will not initiate fracturing in the coal formation. In one or more embodiments, pumping the acidizing agent may be configured as a pretreating step to cleanse the wellbore and wellbore perforations leading into the adjacent formation prior to applying any fracturing techniques. Cleaning the wellbore and wellbore perforations can further include dissolving acid-soluble minerals, as will be discussed in more detail below.

In particular, an acid may be pumped into the wellbore to clean the wellbore itself and existing fracture faces exposed in the coal seams or formations accessible through the perforations. In operation, the acid dissolves precipitates, contaminants, completion fluids, and/or cement resulting from drilling operations. In one embodiment, the acid may include an aqueous solution of about 15 wt % hydrochloric acid (HCl). In other embodiments, however, the methods described herein may employ acid solutions encompassing comparable pH levels and concentrations to the hydrochloric acid without departing from the scope of the disclosure. In at least one embodiment, acetic acid may be used as the acidizing agent.

The method may also include pumping a fracturing fluid into a subsurface coal seam or formation adjacent the wellbore, as at 102. In one embodiment, the fracturing fluid is pumped into adjacent coal seams at a pressure sufficient to initiate the propagation of at least one fracture within the coal formation, thereby exposing additional fracture faces in the coal formation. Although it is possible to use fluids from outside sources, the fracturing fluid may be water produced from the coal formation itself or an adjacent formation.

While not necessary, in one or more embodiments, the fracturing fluid may contain proppants, or propping agents, configured to extend or divert fracture branches, create new fractures, and/or prevent to the fractures from fully closing upon release of the fracturing fluid pressure. In at least one embodiment, The propping agent may have a particle size distribution between about 60 and about 140 mesh, generally known in the art at 100 mesh sand, and useful for extending or diverting branch fractures. In other embodiments, the propping agent may be of a more coarse mesh, such as about 10/20 or about 20/40 mesh proppant, suitable for maintaining fractures open. In one embodiment, the propping agent may be spherical sand. In other embodiments, the propping agent may include resin-coated sand, man-made ceramics, or combinations thereof, depending on the permeability or grain strength needed in the particular application. Carriers such as gels, cellulose derivatives, or synthetic polymers may be added to the fracturing fluid to obtain a sufficient viscosity to suspend the proppants in the fracturing fluid so that the proppants may be generally deposited uniformly about the coal formation. In other embodiments, however, no carriers are mixed with the fracturing fluid since they could have a tendency to damage exposed coal.

The amount of proppant that can be carried in the fracture fluid varies with the type of fluid used, but commonly about 0.2 to about 10 pounds of sand per gallon of fracture fluid may be used. The proppant serves several functions. Its generally-spherical shape substantially reduces abrasion to the face of the fracture, thereby largely eliminating problems associated with particles of coal becoming mixed with the proppant. Also, when the pressure on the fracturing fluid is reduced and the formation face is allowed to compress the proppants, the proppant particles resting in the fractures provide a formation-consolidating effect. Since the permeability of proppant is much greater than that of the coal seam, the fluidic conductivity of the propped fracture may be improved, thereby improving production and overall recovery of CBM from the coal seam.

In one or more embodiments, the fracturing fluid pressure in the coal formation may optionally be released, as at 104, thereby allowing the fracture(s) to substantially close and trap any proppants (if used) in the coal seam fracture(s). In at least one embodiment, the preceding steps 102,104 may be repeated, as at 105, until a satisfactory amount of fracturing has occurred in the coal formation. For example, the fracturing fluid may be pumped into the coal seam in a multiplicity of stages. The rate of pumping may range from about 10 to about 60 barrels per minute to initiate as much branch fracturing as possible. In embodiments employing the use of proppants, succeeding stages of fracturing fluid injection or pumping may incrementally increase the amount of proppant mixed. For example, each incremental increase may be from about 0.2 lb. to about 1 lb. of proppant per gallon of fracturing fluid.

In at least one embodiment, the wellbore and adjacent coal formation may be optionally treated with an acidizing agent after undergoing a fracturing fluid treatment or between repeated fracturing fluid treatment repetitions, as at 103. Specifically, an acid solution can be pumped into the wellbore and the newly formed fractures in the coal formation in order to dissolve impurities and acid-soluble materials, such as calcite, pyrite, or other compounds that will not react with the oxidizing agents generally discussed herein. Removing such materials from the coal seams can prove advantageous since it provides a better contact area accessible by the oxidizing agents discussed herein which would be otherwise blocked from contact with the coal by the calcite, pyrite, etc. Consequently, using an acidizing agent may provide a cleaner pathway for the extraction of hydrocarbons, such as CBM.

In one or more embodiments, the acid may include hydrochloric acid or other acids with comparable pH levels that will dissolve impurities and acid-soluble minerals in the coal, as described above. In one embodiment, the acid is an aqueous solution of about 15 wt % hydrochloric acid. In other embodiments, the acid may include an organic acid, such as lactic acid, acetic acid, formic acid, gluconic acid, ethylene diamine tetracetic acid (EDTA) and nitrilo triacetic acid (NTA), citric acid, oxalic acid, and uric acid. Such organic acids may be much less reactive with metals than other strong mineral acids like hydrochloric acid or mixtures of hydrochloric acid and hydrofluoric acid.

Coal often contains iron in the form of pyrite, and when dissolved in acid, iron precipitation and permeability reduction can occur after acidization. Thus, in at least one embodiment, to prevent undesirable pyrite or iron precipitation, complexing or sequestration agents may be added to the acid. Several organic acids and their derivatives may be considered for this application, but will ultimately depend on temperature, presence of other metallic ions, and costs.

In other embodiments, the fluid pressure is not released, as described at 104, but is instead maintained as the various fluids, such as the oxidizing and acidizing agents, are continuously being pumped into the well and repeated, as at 105, until a satisfactory amount of fracturing has occurred in the coal formation.

The method may further include pumping an oxidizing agent solution into the wellbore and the adjacent coal formation, as at 106. In one embodiment, the oxidizing agent solution may be pumped into the wellbore and formation at about the same rate as the fracturing fluid pumping stages, as described above at 102. In operation, the oxidizing agent solution reacts with coal in a dissolving, or etching process involving the scission of carbon-carbon and carbon-hydrogen bonds, thereby resulting in the formation of carbon-oxygen bonds. During this process, these bonds are broken and volatiles such as carbon dioxide, methane and water, may be released along with other volatile functional groups. The result is the overall mass weight loss of the coal substance accounted for by the generation of channels defined or "etched" into the surface of the coal. The resulting etched channels increase the overall permeability of the coal seam, thereby increasing potential fluid flow for the extraction of hydrocarbons.

In an exemplary embodiment, the oxidizing agent may be an aqueous solution of hydrogen peroxide ($H_2O_2$), which exhibits strong oxidizing properties, especially when directly contacting coal. In other embodiments, however, the oxidizing agent may include sodium hypochlorite, which is less expensive than hydrogen peroxide. Nonetheless, hydrogen peroxide may have less of an adverse impact on the environment and may potentially make the oxidizing process work better. The oxidization process undertaken when hydrogen peroxide contacts coal artificially increases the rank of coal, thereby resulting in a proportional increase in the permeability of the coal. In one or more embodiments, the oxidizing agent solution may contain one or more additives such as surfactants, suspending agents, sequestering agents, anti-sludge agents, and/or corrosion inhibitors. Moreover, if desired for a particular application, the oxidizing agent solution may also contain a proppant. However, the increased permeability of the coal resulting from a suitable oxidizing agent may serve to either reduce, or totally eliminate, the need for propping agents in the oxidizing agent solution.

After treating the coal formation with an oxidizing agent, an acidizing agent may again optionally be pumped into the formation, as at 108. As with previous acidizing treatments 101, 103, an acid solution can be pumped into the wellbore and the adjacent coal formation to dissolve acid-soluble materials that do not react with the oxidizing agents. The removal of such materials can provide a less tortuous pathway for the extraction of hydrocarbons from the coal formation. In one or more embodiments, the acid may include hydrochloric acid, acetic acid, combinations thereof, or other acids with comparable pH levels that will react with coal seam precipitates.

In one or more embodiments, the preceding treatments 102, 103, 104, 105, 106, 108 generally described above may then be repeated, as at 110. Repetition of such treatments may continue until the fractures in the coal formation are propagated to a predetermined length or the fracture faces have been adequately etched by the oxidizing agent for increased hydrocarbon fluid flow. In at least one embodiment, around 100 barrels of oxidizing agent solution may be alternatingly pumped with around 100 barrels of fracturing fluid, with acidizing treatments intermittently spaced therebetween.

In some applications, the foregoing treatments 102, 103, 104, 105, 106, 108 may result in the accumulation of coal fines generated by either the mechanical fracturing of the coal seam or the chemical oxidation of the coal. An excess of fines in a coal seam, especially near the wellbore intake, may impede the extraction of hydrocarbons from the coal seam. Consequently, the method may also include overflushing the wellbore and adjacent coal formation with a fluid, as at 112, to move any generated coal fines away from the wellbore intake. Overflushing may include pumping into the wellbore and adjacent formation a volume of about 100 to about 300 barrels of fluid above the wellbore capacity. In an exemplary embodiment, overflushing may be completed using fresh water, formation water, salt water, combinations thereof, or the like. In operation, overflushing may transport a substantial portion of the fines deep into the coal seam and/or fracture system and away from the wellbore, thereby allowing more efficient hydrocarbon recovery.

Figure 2:
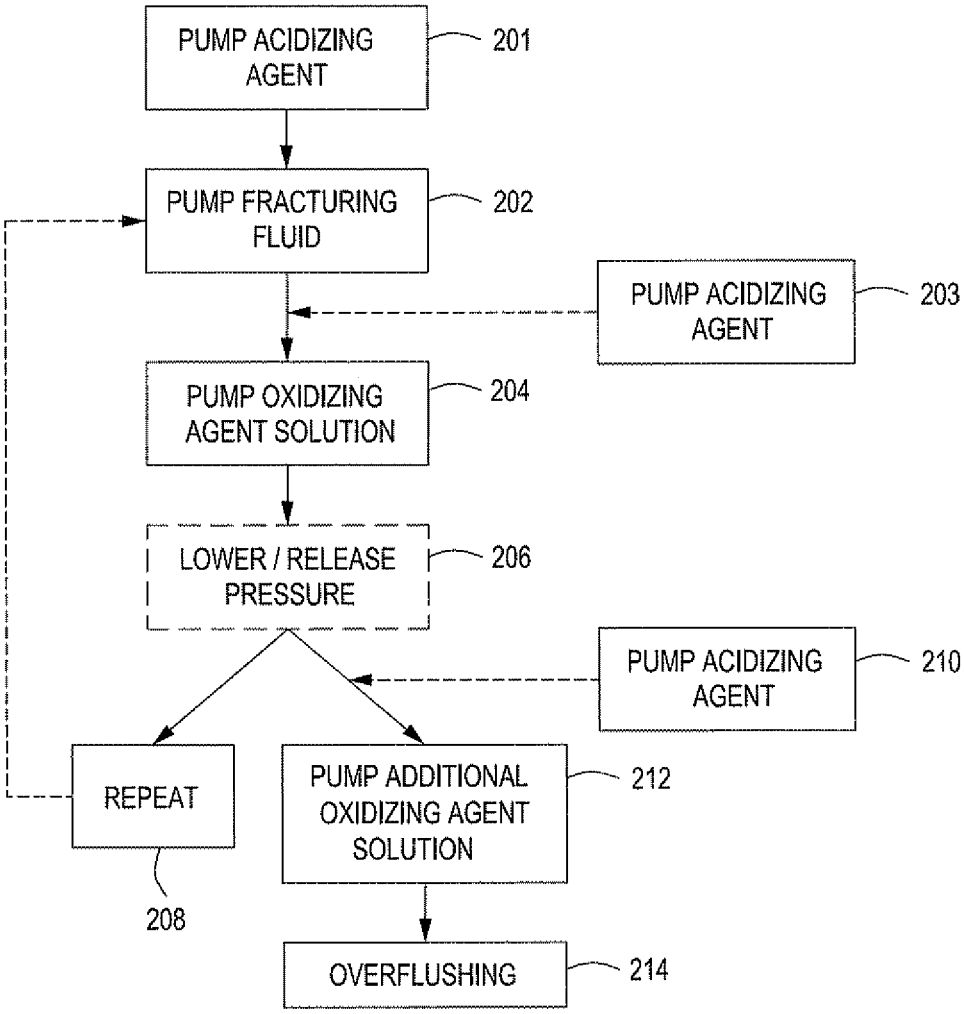
FIG. 2 is a schematic flowchart of another method according to one or more aspects of the present disclosure.

Referring now to FIG. 2, another exemplary method of fracturing a coal formation adjacent a wellbore for hydrocarbon recovery is depicted. As with previously-described embodiments, the method may include pumping an acidizing agent into the wellbore as a pretreating step configured to cleanse the wellbore and perforations prior to applying any fracturing techniques and wellbore perforations, as at 201. The acidizing treatment 201 may be substantially similar to the treatment 101 described above, and therefore will not be discussed in detail. A fracturing fluid may then be pumped into the wellbore and adjacent coal formation at a pressure sufficient to initiate the propagation of at least one fracture within the coal seam, thereby exposing at least one fracture face, as at 202. In at least one embodiment, the fracturing fluid may be proppant-free. As can be appreciated, any resulting fractures may be extended or otherwise widened by continuing to increase the pressure of the fracturing fluid into the coal formation.

In at least one embodiment, the newly fractured coal formation may be optionally treated with an acidizing agent after undergoing the fracturing fluid treatment, as at 203. In operation, an acid solution, such as hydrochloric acid or acetic acid, can be pumped into the wellbore and the newly formed fractures to dissolve acid-soluble materials that may not react with the oxidizing agents generally discussed herein. As can be appreciated, acidizing the coal seam provides a cleaner pathway for the extraction of hydrocarbons, such as CBM.

The method may also include pumping an oxidizing agent solution into the coal seam at a pressure equal to or greater than the pressures exerted by the fracturing fluid, as at 204. The high pressures maintained by pumping the oxidizing agent solution on the coal formation may cause the existing fractures to be held open, and the generation of new fractures may result as the oxidizing agent solution is pumped through the existing fractures. As the oxidizing agent courses through the newly created fractures, it attacks the faces of the fractures causing fluid-flow channels to be etched therein, as generally described above. As with previously-described embodiments, the oxidizing agent may include an aqueous solution of hydrogen peroxide, but may also include sodium hypochlorite.

The pressure in the coal formation may then be optionally lowered to allow the newly created fractures to close, as at 206. As the fractures close, several etched channels are left on the faces of the fractures that are capable of fluid flow therethrough. The resulting fluid-flow channels may reduce, or eliminate completely, the need for any propping agents, since the necessary permeability of the coal seam may be achieved through etching of the coal surfaces. In other embodiments, however, the fluid pressure is not fully released, as at 206, but is instead maintained as the various fluids, such as the oxidizing and acidizing agents, are continuously being pumped into the well.

In at least one embodiment, the preceding treatments 202, 203, 204 generally described above may be repeated, as at 208. Specifically, the coal formation may be hydraulically fractured and stimulated again and again by alternatingly pumping fracturing fluids and oxidizing agents into the coal formation. Acidizing treatments may also be intermittently introduced into such repetitions to clean the wellbore and formation, without departing from the scope of the disclosure. This process can be followed or repeated until sufficient fractures and/or fluid-flow channels have been created in the coal seam.

The method may further include pumping additional oxidizing agent solution into the coal formation, as at 212, at a pressure below the pressure gradient at which the fracturing of the formation occurred, but sufficient to cause the oxidizing agent to flow through the channels formed in the fracture faces. As the additional oxidizing agent solution, such as hydrogen peroxide, flows through the etched channels, the channels may be further etched and enlarged. In exemplary operation, the additional oxidizing agent solution pumped through the closed fractures does not necessarily contact portions of the fracture faces. As a result, the non-contacted portions of the fracture faces may provide formation support by preventing the fracture faces from crushing together and destroying the newly created flow channels. As such, propping agents may not be necessary as the desired permeability of the coal seam is achieved solely through the etching of the exposed coal surface.

Optionally, an acidizing agent may be pumped into the formation prior to pumping additional oxidizing agent solution, as at 210. The acid solution can be pumped into the wellbore and the adjacent coal formation to dissolve acid-soluble materials that do not react with the oxidizing agents. The removal of such materials can provide a less tortuous pathway for the extraction of hydrocarbons from the coal formation. If desired or warranted, the wellbore and coal seam may then be overflushed, as at 214 and substantially similar to the treatment 112 described above, to move any generated coal fines away from the wellbore intake, thus increasing hydrocarbon recovery efficiency.

Figure 3:
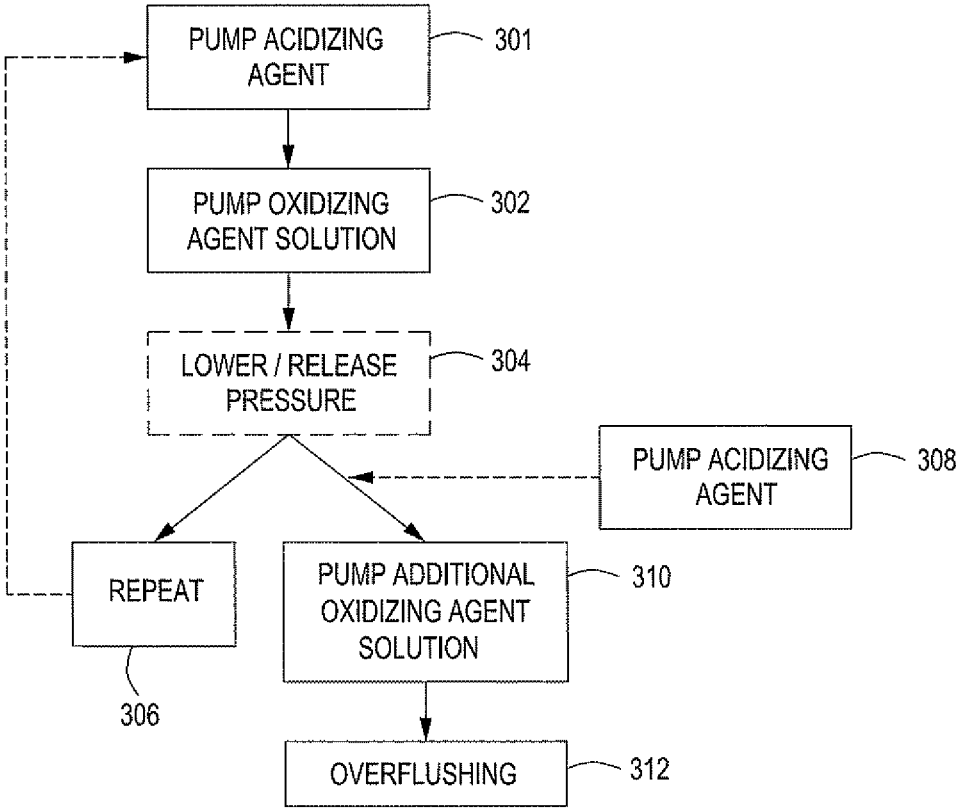
FIG. 3 is a schematic flowchart of another method according to one or more aspects of the present disclosure.

Referring now to FIG. 3, another exemplary method of fracturing a coal formation adjacent a wellbore for hydrocarbon recovery is depicted. The method may include pumping an acidizing agent solution into the wellbore as a pretreating technique, as at 301. The acidizing treatment 301 may be substantially similar to the treatment 101 described above, and therefore will not be discussed in detail. The method may include pumping an oxidizing agent solution into the wellbore and adjacent coal formation at a pressure sufficient to initiate the propagation of at least one fracture within the coal formation, thereby exposing at least one fracture face, as at 302. As with embodiments discussed above, the oxidizing agent may include hydrogen peroxide, but may also include other solutions that act substantially similar to hydrogen peroxide when in contact with coal, such as sodium hypochlorite.

Pumping oxidizing agent solution into the coal seam under pressure not only results in the hydraulic fracturing of the coal seam, but also etches the newly exposed fractures thereby providing amplified conductivity and permeability of the coal formation. In at least one embodiment, the oxidizing agent pumped into the coal formation may include propping agents. However, since the oxidizing agent chemically reacts with the coal and creates fluid-flow channels thereon, the need for proppant may be reduced or even eliminated entirely. As can be appreciated, significant savings of time and operating expenses can be accrued by not having to use conventional fracturing fluids or provide an appropriate propping agent.

Once the fractures have been extended and etched by the oxidizing agent to form channels therein, the hydraulic pressure exerted on the formation may then be optionally released, as at 304. In other embodiments, however, the fluid pressure is not fully released but is instead maintained as various fluids, such as the oxidizing and acidizing agents, are continuously being pumped into the well. If the pressure is released, the fractures may close but leave several etched channels in the coal capable of hydrocarbon fluid flow. In at least one embodiment, the preceding treatments 301, 302 generally described above may be repeated, as at 306. Specifically, the coal formation may be hydraulically fractured and stimulated again and again by alternatingly pumping acidizing agents and oxidizing agents into the coal formation until a desired amount of fractures in the coal formation have been obtained and fluid flow channels have been adequately etched therein.

In one embodiment, additional oxidizing agent solution may be pumped into the coal formation, as at 310, at a pressure below the pressure at which the fracturing of the formation occurred, but sufficient to cause the oxidizing agent solution to flow through the channels formed in the at least one fracture face. This additional oxidizing agent may serve to enlarge the channels, thereby resulting in greater permeability of the coal seam for increased hydrocarbon fluid flow. Optionally, an acidizing agent solution may be pumped into the formation prior to injecting the additional oxidizing agent solution, as at 308, to dissolve acid-soluble materials that do not react with the oxidizing agents and provide a less tortuous pathway for the extraction of hydrocarbons from the coal formation. If desired, the wellbore and coal seam may then be overflushed, as at 312 and as generally described in the treatment 112 above.

Figure 4:
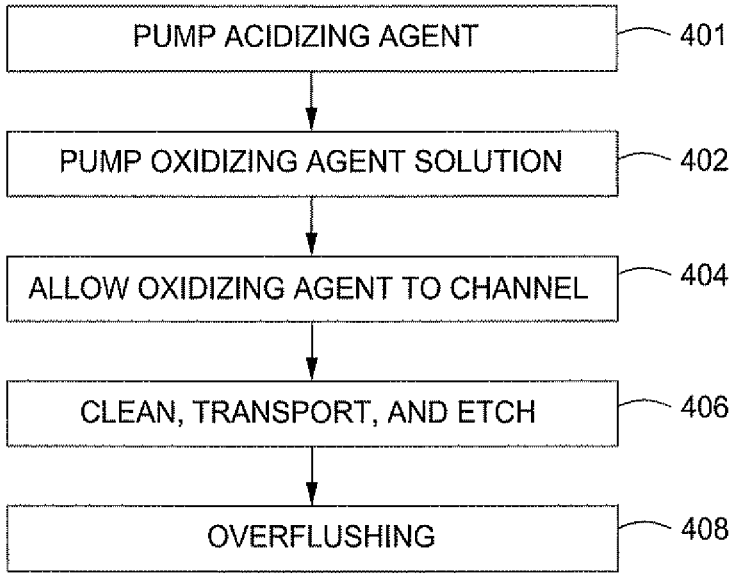
FIG. 4 is a schematic flowchart of another method according to one or more aspects of the present disclosure.

Referring now to FIG. 4, an exemplary method of fracturing a coal formation that has previously been treated and/or stimulated using prior methods is depicted. The existing wellbore and previously-stimulated coal formation may be treated with an acidizing agent solution, such as hydrochloric acid or acetic acid, as at 401. The acidizing treatment 401 may be substantially similar to the treatment 101 described above, and therefore will not be discussed in detail.

At a pressure below the fracture gradient of the coal seam, an oxidizing agent solution may be pumped into the existing wellbore and adjacent coal seam that was previously stimulated, as at 402. As the oxidizing agent solution passes or channels through the existing coal seam fractures generated by previous stimulation operations, as at 404, it may serve several functions. For example, as at 406, it may serve as a cleansing agent and dissolve any precipitates or contaminants that may be present at or adjacent to the wellbore or fracture faces due to drilling or completion fluids or cement. It may also dissolve any existing coal fines or transport them away from the wellbore intake and into the coal seam fractures. Lastly, it may further etch or enhance any existing fluid flow channels in the fracture faces for improved coal seam permeability. If desired, the wellbore and coal seam may then be overflushed, as at 408 and as generally described above at 112, to move any coal fines generated by the oxidizing agent solution away from the wellbore intake, thus increasing hydrocarbon recovery efficiency.

Figure 5:
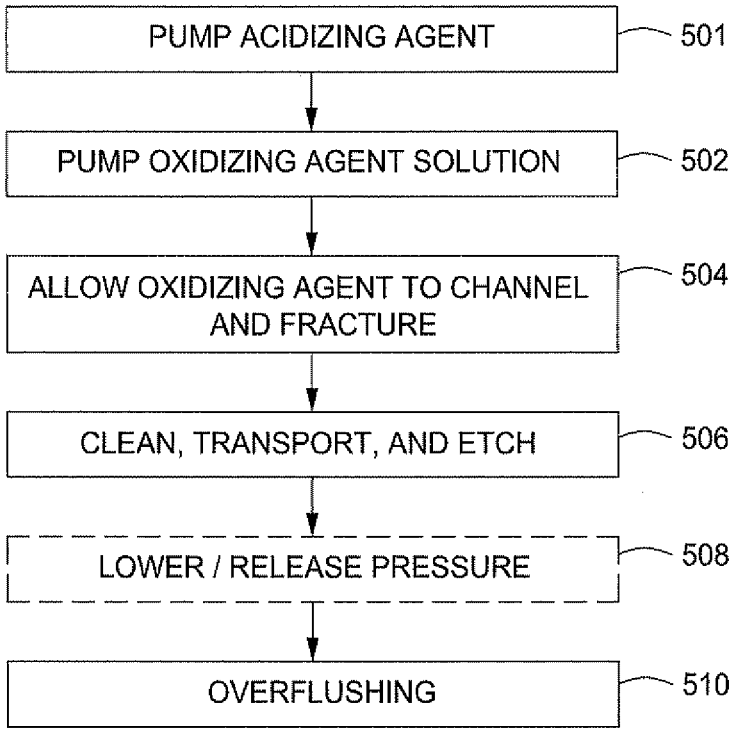
FIG. 5 is a schematic flowchart of another method according to one or more aspects of the present disclosure.

Referring now to FIG. 5, other embodiments of the disclosure can include pumping an oxidizing agent at a pressure sufficient to create new fractures or extend existing fractures in a coal seam that has previously been treated and/or stimulated using other methods, but may produce additional CBM if now stimulated by an oxidizing agent. The existing wellbore and previously-stimulated coal formation may be treated with an acidizing agent solution, as at 501. The acidizing treatment 501 may be substantially similar to the treatment 101 described above, and therefore will not be discussed in detail.

At a rate and pressure sufficient to extend existing fractures or create new fractures therein, an oxidizing agent solution, such as hydrogen peroxide, may be pumped into an existing wellbore and adjacent coal seam that were previously stimulated using prior methods, as at 502. As it channels through the coal formation, as at 504, the oxidizing agent extends existing fractures and forms new fractures. Moreover, the oxidizing agent may serve several other functions, as at 506. For example, it may serve as a cleansing agent by dissolving precipitates or contaminants which may be present at or adjacent the wellbore or fracture faces due to drilling or completion fluids or cement. It may also dissolve any existing coal fines or transport them away from the wellbore intake and into the coal seam fractures. The oxidizing agent may further etch or enhance any existing fluid flow channels in the fracture faces for improved coal seam permeability.

Once at least one fracture has been created, extended, or etched by the oxidizing agent, the pressure exerted on the formation may optionally be reduced, as at 508. In other embodiments, however, the fluid pressure is not fully released but is instead maintained as the various fluids, such as the oxidizing and acidizing agents, are continuously being pumped into the well. If the pressure is reduced, several channels in the coal seam capable of fluid flow may remain therein. If desired, the wellbore and coal seam may then be overflushed, as at 510 and as generally described above at 112, to move any coal fines generated by the oxidizing agent solution away from the wellbore intake, thus increasing hydrocarbon recovery efficiency.

In support of the various embodiments described herein, Applicants have reached and applied several conclusions regarding the effects of oxidizing agents on coal. Such conclusions are detailed extensively in the Ph.D. dissertation in petroleum engineering entitled "Optimizing Coalbed Methane Production in the Illinois Basin," authored by Marshall Charles Watson, B.S., M.S. and submitted to the Graduate Faculty of Texas Tech University in May 2008. The dissertation is hereby incorporated by reference in its entirety to the extent that it is not inconsistent with the present disclosure. By way of explanation, and without being bound by any theory, a few of the conclusions reached in the incorporated dissertation are as follows:

Coal desulfurization tests have shown that the oxidization of coal using sodium hypochlorite resulted in overall weight loss. Oxidization yields several products depending on the pH of the base solution and the rank or type of coal. Products vary from black, high molecular weight bicarbonate soluble acids to the benzene poly-carboxylic acids and carbon dioxide. It has been shown that the greater the pH level of the base, the more coal is actually oxidized or dissolved. On the other hand, at lower pH levels (e.g., 9.0-11.0), production of soluble acids was lower whereas the production of $CO_2$ was higher. In one experiment, an 80 percent loss of original carbon was explained as follows: 13.6 percent insoluble residue, 54.9 percent colored acid soluble in an aqueous bicarbonate, 7.1 percent light colored acid soluble in water, and 19.9 percent in $CO_2$.

For the purposes of leaching coal, it was found that single-step leaching with sodium hypochlorite resulted in excessive weight losses. Initial tests were carried out with a 0.4 Molar sodium hypochlorite concentration at room temperature. In one test, a gas evolved from the reaction and the resultant bubbles were believed to be $CO_2$ on top of the leached solution. The test involved a 20 g coal sample leached in 100 ml of 0.4 Molar sodium hypochlorite solution. The sodium hypochlorite had an initial pH level of 11.41 and was at room temperature. Soon after, adding the coal into the hypochlorite solution, the temperature increased continuously to 39° Celsius in 30 minutes.

The foregoing disclosure and description of the disclosure is illustrative and explanatory thereof. Various changes in the details of the illustrated construction may be made within the scope of the appended claims without departing from the spirit of the disclosure. While the preceding description shows and describes one or more embodiments, it will be understood by those skilled in the art that various changes in form and detail may be made therein without departing from the spirit and scope of the present disclosure. For example, various steps of the described methods may be executed repetitively, combined, further divided, replaced with alternate steps, or removed entirely. In addition, different shapes and sizes of elements may be combined in different configurations to achieve the desired earth retaining structures. Therefore, the claims should be interpreted in a broad manner, consistent with the present disclosure.

I claim:

1. A method of fracturing a subsurface coal formation penetrated by a well, comprising:

treating the well and the subsurface coal formation with an acid to dissolve precipitates, contaminants, completion fluids, or cement which may be present at or adjacent the well;

pumping a fracturing fluid containing propping agents into the subsurface coal formation adjacent the well in a multiplicity of stages and at a pressure sufficient to initiate the propagation of at least one fracture within the coal formation;

pumping additional acid into the well and the at least one fracture to dissolve acid-soluble materials;

alternatingly pumping an oxidizing agent solution into the subsurface coal formation following each of the multiplicity of stages, whereby the oxidizing agent solution etches channels into fracture faces; and overflushing the subsurface coal formation with a fluid configured to transport accumulated coal fines deeper into the subsurface coal formation for improved methane extraction.

2. The method of claim 1, further comprising allowing the at least one fracture to close thereby trapping the propping agents in the at least one fracture to prevent the at least one fracture from fully closing.

3. The method of claim 1, wherein the acid comprises an aqueous solution of hydrochloric acid.

4. The method of claim 1, wherein the acid comprises an aqueous solution of acetic acid.

5. The method of claim 1, wherein the oxidizing agent solution is hydrogen peroxide.

6. The method of claim 1, wherein the oxidizing agent solution is sodium hypochlorite.

7. A method of fracturing a subsurface coal formation penetrated by a well, comprising:

treating the well and the subsurface coal formation with an acid to clean the well and subsurface coal formation;

pumping a fracturing fluid into the subsurface coal formation to induce at least one fracture thereby exposing at least one fracture face;

pumping additional acid into the well and the at least one fracture to dissolve acid-soluble materials; and pumping an oxidizing agent solution into the subsurface coal formation while maintaining the at least one fracture in an open position to etch channels into the at least one fracture face.

8. The method of claim 7, further comprising overflushing the subsurface coal formation with a fluid configured to transport accumulated coal fines deeper into the subsurface coal formation for improved methane extraction.

9. The method of claim 7, further comprising allowing the at least one fracture to close so that the channels remain for fluid flow.

10. The method of claim 7, further comprising pumping additional oxidizing agent solution at a pressure less than a pressure sufficient to create and open the at least one fracture such that the at least one fracture remains closed while the additional oxidizing agent solution is pumped through the channels to enlarge the channels.

11. The method of claim 7, wherein the fracturing fluid contains propping agents.

12. The method of claim 7, wherein the acid comprises an aqueous solution of hydrochloric acid.

13. The method of claim 7, wherein the oxidizing agent solution is an aqueous solution of hydrogen peroxide.

14. The method of claim 7, wherein the oxidizing agent solution is sodium hypochlorite.

15. A method of fracturing a subsurface coal formation penetrated by a well, comprising:

treating the well and the subsurface coal formation with an acid to clean the well and remove acid-soluble minerals from the subsurface coal formation;

pumping an oxidizing agent solution into the subsurface coal formation at a pressure sufficient to create and open at least one fracture, thereby exposing at least one fracture face to be etched by the oxidizing agent solution and form channels thereon;

pumping additional acid into the well and the at least one fracture to dissolve acid-soluble materials; and pumping additional oxidizing agent solution at a pressure less than the pressure sufficient to create and open the at least one fracture such that the at least one fracture closes while the additional oxidizing agent solution is pumped through the channels to enlarge the channels.

16. The method of claim 15, further comprising overflushing the subsurface coal formation with a fluid configured to transport accumulated coal fines deeper into the subsurface coal formation for improved methane extraction.

17. The method of claim 15, wherein the acid comprises an aqueous solution of hydrochloric acid.

18. The method of claim 15, wherein the oxidizing agent solution is an aqueous solution of hydrogen peroxide.

19. The method of claim 15, wherein the oxidizing agent solution is sodium hypochlorite.

20. The method of claim 15, wherein the oxidizing agent solution contains propping agents.

21. A method of stimulating a subsurface coal seam penetrated by a wellbore having a wellbore intake, wherein the subsurface coal seam was previously stimulated, comprising:

treating the wellbore and the subsurface coal seam with an acid to clean the wellbore and subsurface coal seam;

pumping an oxidizing agent solution into the wellbore and subsurface coal seam at a pressure below the fracture pressure of the subsurface coal seam, wherein the subsurface coal seam has at least one existing fracture;

allowing the oxidizing agent solution to channel through the at least one existing fracture; and overflushing the subsurface coal formation with a fluid configured to transport accumulated coal fines deeper into the subsurface coal formation for improved methane extraction.

22. A method of stimulating a subsurface coal seam penetrated by a wellbore having a wellbore intake, wherein the subsurface coal seam was previously stimulated, comprising:

treating the wellbore and the subsurface coal seam with an acid to clean the wellbore and subsurface coal seam;

pumping an oxidizing agent solution into the wellbore and subsurface coal seam to cause a pressure on the subsurface coal seam sufficient to create and open at least one fracture;

allowing the oxidizing agent solution to channel through the at least one existing fracture; and overflushing the subsurface coal formation with a fluid configured to transport accumulated coal fines deeper into the subsurface coal seam for improved methane extraction.

23. The method of claim 22, wherein the acid comprises an aqueous solution of hydrochloric acid.

24. The method of claim 23, further comprising reducing the pressure on the subsurface coal seam so that the at least one fracture closes but the fluid flow channels remain for fluid flow.

* * * * *